US006857505B1

(12) United States Patent
Mason et al.

(10) Patent No.: US 6,857,505 B1
(45) Date of Patent: Feb. 22, 2005

(54) APPARATUS AND METHOD FOR UTILIZING AN EXISTING SOFTWARE APPLICATION DURING OPERATION OF A CONVERTIBLE CHECKOUT TERMINAL

(75) Inventors: Timothy E. Mason, Buford, GA (US); Robert F. Sadler, Cumming, GA (US); Scott A. Barnhart, North Bend, WA (US)

(73) Assignee: NCR Corporation, Dayton, OH (US)

( * ) Notice: Subject to any disclaimer, the term of this patent is extended or adjusted under 35 U.S.C. 154(b) by 176 days.

(21) Appl. No.: 10/191,172

(22) Filed: Jul. 9, 2002

Related U.S. Application Data

(60) Provisional application No. 60/307,821, filed on Jul. 25, 2001.

(51) Int. Cl.[7] ..... A47F 10/00
(52) U.S. Cl. ..... 186/59
(58) Field of Search ..... 186/59, 52, 61; 235/2, 7 R, 7 A

(56) References Cited

U.S. PATENT DOCUMENTS

| | | | | |
|---|---|---|---|---|
| 3,990,540 A | * 11/1976 | Aleshire et al. | 186/61 |
| 4,191,999 A | 3/1980 | Kashio | 364/405 |
| 4,502,120 A | 2/1985 | Ohnishi et al. | 364/405 |
| 4,817,041 A | * 3/1989 | Sakamoto | 705/16 |
| 4,940,116 A | 7/1990 | O'Conner et al. | 186/61 |
| 4,954,697 A | 9/1990 | Kokubun et al. | 235/381 |
| 5,083,638 A | 1/1992 | Schneider | 186/61 |
| 5,168,961 A | 12/1992 | Schneider | 186/52 |
| 5,426,282 A | 6/1995 | Humble | 235/383 |
| 5,494,136 A | 2/1996 | Humble | 186/61 |
| 5,537,548 A | 7/1996 | Fin et al. | 395/200.04 |
| 5,615,759 A | 4/1997 | Cadbury | 194/206 |
| 5,758,326 A | 5/1998 | Ishikawa | 705/16 |
| RE36,109 E | 2/1999 | Kipp | 235/383 |
| 5,978,772 A | * 11/1999 | Mold | 705/16 |
| 5,992,570 A | 11/1999 | Walter et al. | 186/36 |
| 6,067,529 A | 5/2000 | Ray et al. | 705/26 |

FOREIGN PATENT DOCUMENTS

| | | | |
|---|---|---|---|
| EP | 0.315.088 A2 * | 5/1989 | G07G/1/14 |
| EP | 0.349.997 A1 * | 1/1990 | G07G/1/12 |

* cited by examiner

*Primary Examiner*—Donald P. Walsh
*Assistant Examiner*—Mark J Beauchaine
(74) *Attorney, Agent, or Firm*—Maginot, Moore & Beck LLP

(57) ABSTRACT

A method of operating a checkout terminal includes the step of detecting generation of a peripheral-request control signal. The peripheral-request control signal including instructions for operating a retail peripheral device. The method also includes the step of generating a dispenser control signal in response to the detecting step. Moreover, the method includes the step of operating a currency dispenser so as to dispense an amount of change due to a customer in response to the dispenser control signal. The currency dispenser is distinct from the retail peripheral device. A checkout terminal is also disclosed.

26 Claims, 6 Drawing Sheets

APPARATUS AND METHOD FOR UTILIZING AN EXISTING SOFTWARE APPLICATION DURING OPERATION OF A CONVERTIBLE CHECKOUT TERMINAL

PROVISIONAL PATENT APPLICATION

This application claims the benefit of U.S. Provisional Application Ser. No. 60/307,821, filed Jul. 25, 2001, the disclosure of such application being totally incorporated herein by reference in its entirety.

TECHNICAL FIELD OF THE INVENTION

The present invention relates generally to a checkout terminal, and more particularly to an apparatus and method for utilizing an existing software application during operation of a convertible checkout terminal.

BACKGROUND OF THE INVENTION

In the retail industry, the largest expenditures are typically the cost of the goods sold followed closely by the cost of labor expended. The impetus to reduce labor costs has focused on reducing or eliminating the amount of time required to handle and/or process the items or goods to be purchased by a customer. To this end, there have been a number of self-service checkout terminals developed which attempt to substantially eliminate the need for a checkout clerk.

A self-service checkout terminal is operated by a customer without the aid of a checkout clerk. Hence, during operation of a self-service checkout terminal, the customer scans individual items for purchase across a scanner and then places the scanned items into a bag, if desired. The customer then pays for his or her purchases either at the self-service checkout terminal if so equipped, or at a central payment area which is staffed by a store employee. Thus, a self-service checkout terminal permits a customer to select, itemize, and in some cases pay for his or her purchases without the assistance of the retailer's personnel.

However, it should be appreciated that a given retailer may have a number of reservations in regard to implementation of self-service checkout terminals into the retailer's operation. In particular, a number of retailers fear that the retailer's customers may not embrace the idea of using self-service checkout terminals to checkout their items for purchase thereby potentially causing the terminals to go unused in the retailer's store. In such a situation, the retailer would have expended a relatively substantial sum of money for a checkout terminal which is not being utilized thereby increasing costs associated with the retailer's operation.

As a result of this, a number of "convertible" checkout terminals have heretofore been designed. A convertible checkout terminal is a system that can be operated in a "self-service mode" in which a customer operates the terminal without the assistance of store personnel, but also transformed in order to be operated in an "assisted mode" in which the terminal is operated by a checkout clerk or the like. Such terminals have the advantage in that the operation of the terminal may be altered to fit the immediate needs of the retailer's operation.

In regard to such convertible checkout terminals, many times certain pieces of hardware go unutilized based on whether the terminal is being operated in its self-service mode or assisted mode. For example, a convertible checkout terminal may be equipped with currency handlers such as cash acceptors and cash dispensers which are utilized when the terminal is being operated in self-service mode, but, for various reasons, are not utilized during operation of the terminal in its assisted mode. Once such reason is that the retailer may desire to simply have the clerk collect cash and thereafter tender change via use of a cash drawer or the like since the clerk is present anyway.

Another reason involves the software applications being utilized during operation of the terminal. Specifically, for issues such as cost and reliability, the software application being utilized during operation of the checkout terminal in assisted mode is often the same software application that is utilized in dedicated assisted checkout terminals (i.e. non-convertible, clerk-operated terminals). As such, the software application is generally not configured to provide for operation of the cash acceptors and cash dispensers since such components are not present on dedicated assisted checkout terminals. One manner to overcome this problem is to completely rewrite the software application to provide for such functionality. However, this approach is very expensive and is not likely to be commercially acceptable, especially in the case of retrofitting existing terminals already owned by the retailer.

What is needed therefore is a checkout terminal which overcomes one or more of the above-mentioned drawbacks. What is particularly needed is a method and apparatus of operating a checkout terminal which allows for the utilization of additional hardware without requiring the rewriting of the terminal's original software application.

SUMMARY OF THE INVENTION

In accordance with a first embodiment of the present invention, there is provided a method of operating a checkout terminal. The method includes the step of detecting generation of a peripheral-request control signal. The peripheral-request control signal including instructions for operating a retail peripheral device. The method also includes the step of generating a dispenser control signal in response to the detecting step. Moreover, the method includes the step of operating a currency dispenser so as to dispense an amount of change due to a customer in response to the dispenser control signal. The currency dispenser is distinct from the retail peripheral device.

In accordance with a second embodiment of the present invention, there is provided a checkout terminal. The checkout terminal includes a retail peripheral device. The checkout terminal also includes a currency dispenser which is distinct from the retail peripheral device. The checkout terminal yet further includes a processing unit electrically coupled to both the retail peripheral device and the currency dispenser. Moreover, the checkout terminal includes a memory device electrically coupled to the processing unit. The memory device has stored therein a plurality of operating instructions which, when executed by the processing unit, causes the processing unit to (a) detect generation of a peripheral-request control signal, the peripheral-request control signal including peripheral instructions for operating the retail peripheral device, (b) generate a dispenser control signal in response to the detection of generation of the peripheral request control signal, and (c) operate the currency dispenser so as to dispense the amount of change due to a customer in response to the dispenser control signal.

In accordance with a third embodiment of the present invention, there is provided a method of operating a checkout terminal. The method includes the step of detecting generation of a display-device control signal. The display-device control signal includes instructions for displaying information on the display device. The method also includes the step of generating a currency control signal in response to the detecting step. The method also includes the step of operating a currency handler in response to the currency control signal.

It is therefore an object of the present invention to provide a new and useful checkout terminal.

It is moreover an object of the present invention to provide an improved checkout terminal.

It is a further object of the present invention to provide a new and useful method of operating a checkout terminal.

It is also an object of the present invention to provide an improved method of operating a checkout terminal.

It is yet another object of the present invention to provide a method and apparatus for operating a checkout terminal which allows for the utilization of additional hardware without requiring the rewriting of the terminal's original software application.

The above and other objects, features, and advantages of the present invention will become apparent from the following description and the attached drawings.

DETAILED DESCRIPTION OF THE INVENTION

Figure 1:
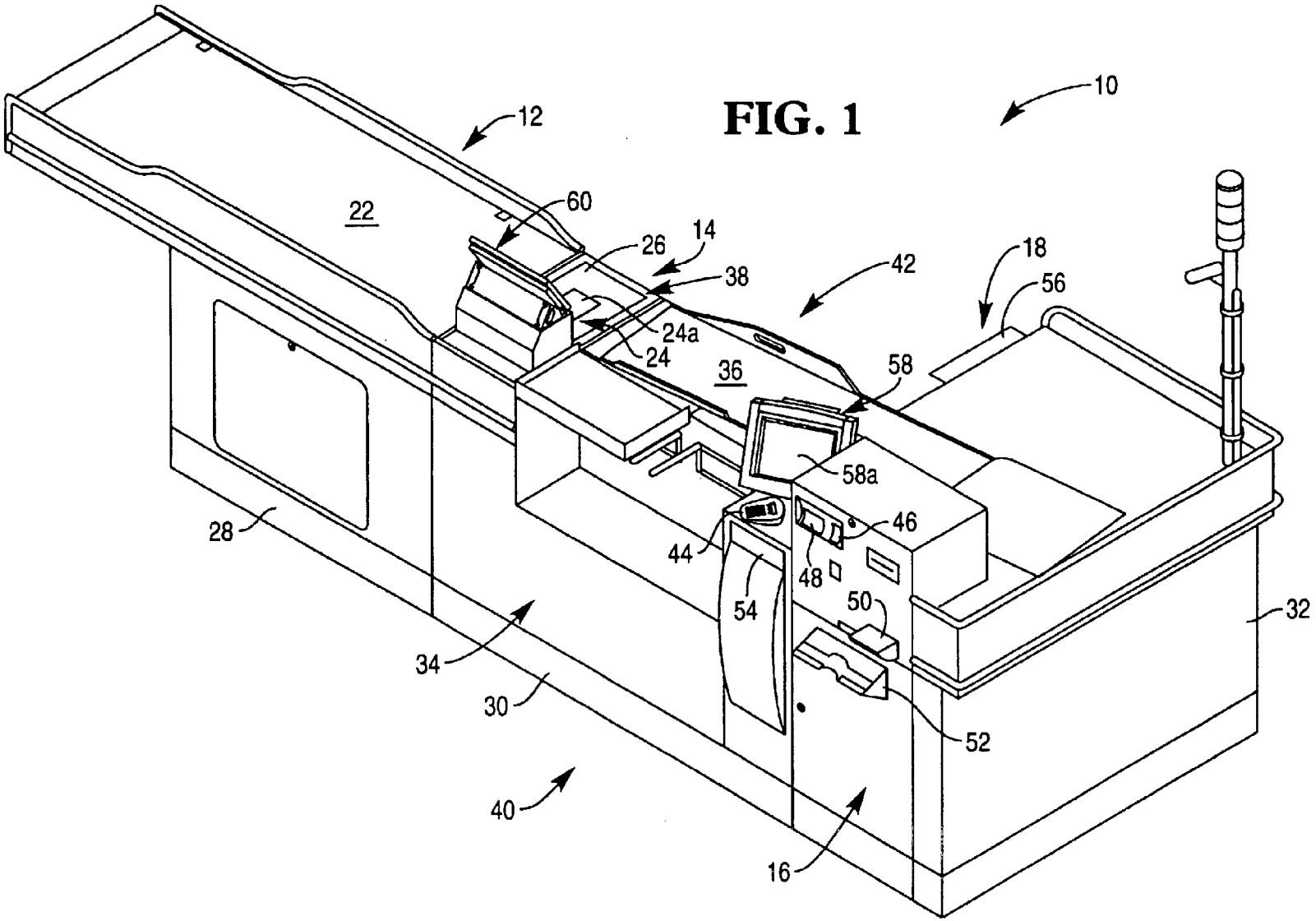
FIG. 1 is a perspective view of a retail checkout terminal which incorporates the features of the present invention therein; note that the terminal is shown in its assisted terminal configuration.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
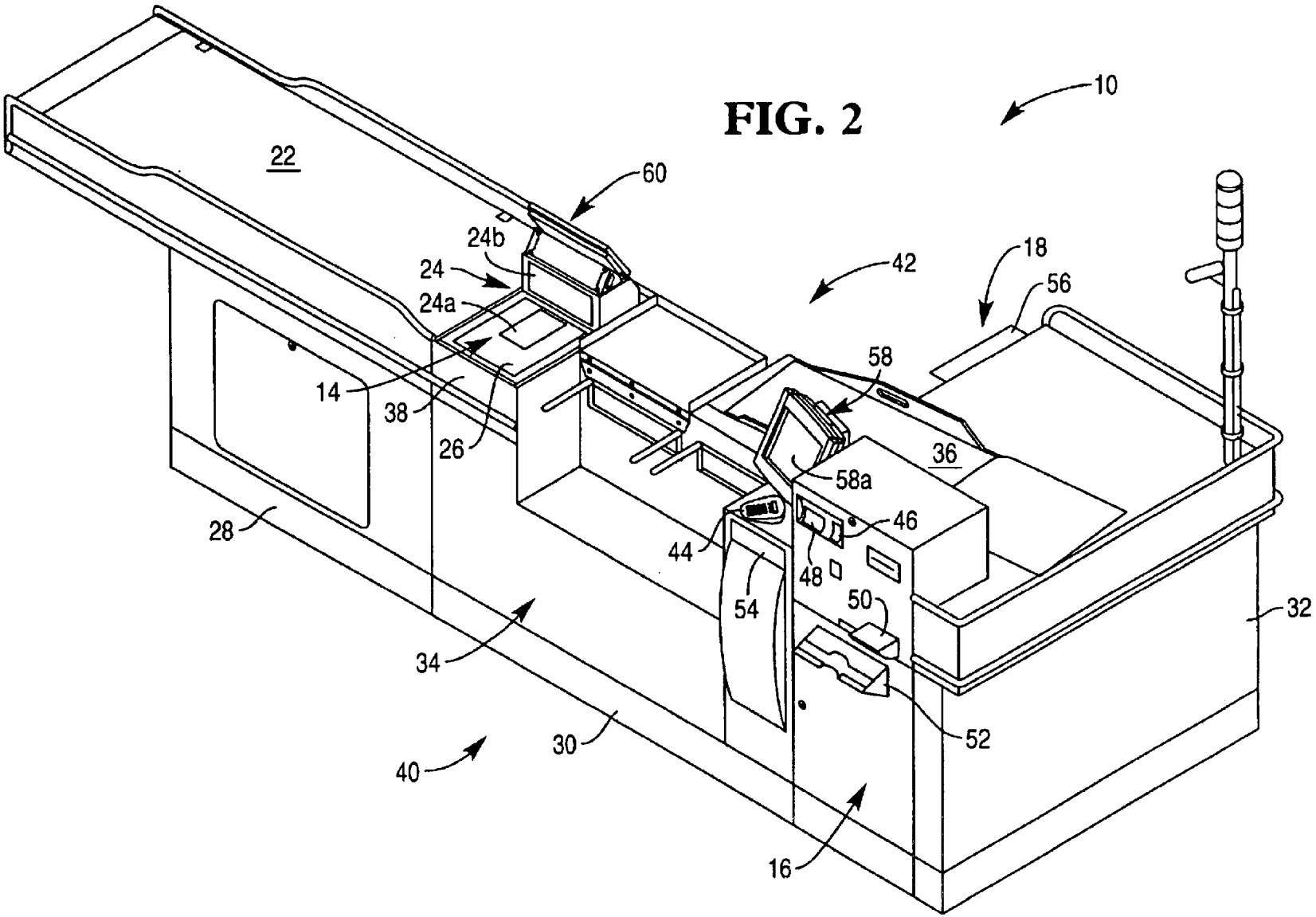
FIG. 2 is a view similar to FIG. 1, but showing the checkout terminal configured in its self-service terminal configuration.
Figure 3:
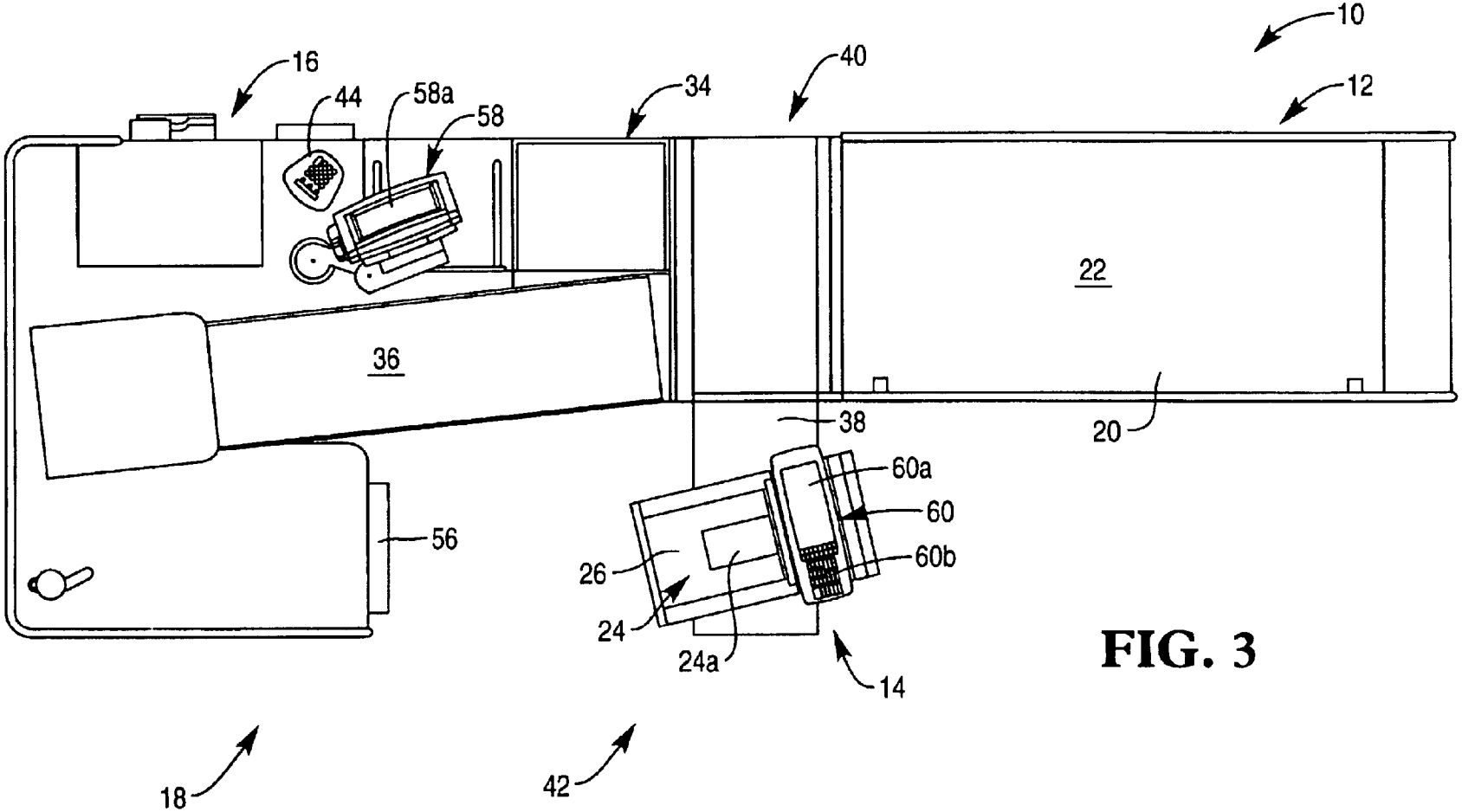
FIG. 3 is a plan view of the checkout terminal of FIGS. 1 and 2 which shows the scanner assembly during rotation thereof.

Referring now to FIGS. 1–3, there is shown a retail checkout terminal 10 for use in a retail business such as a grocery store or supermarket. The checkout terminal 10 is configured to be operated in either an "assisted mode of operation" or a "self-service mode of operation". What is meant herein by the term "assisted mode of operation" is a mode or configuration in which the checkout terminal 10 is operated with the assistance of retail personnel such as a checkout clerk. Conversely, what is meant herein by the term "self-service mode of operation" is a mode or configuration in which the checkout terminal 10 is operated by the customer himself or herself without the assistance of a clerk or other personnel employed by the retailer.

In addition, what is meant herein by the term "customer" is a person who enters a retailer's store, selects his or her items for purchase from the shopping area of the store, checks out his or items for purchase at a checkout terminal such as the checkout terminal 10 (including tendering payment for his or her items for purchase), and then exits the store subsequent to tendering payment. Hence, as used herein, a customer is distinguished from retail personnel such as a checkout clerk or other employee of the retailer in that a customer enters the retailer's store for the sole purpose of purchasing items from the store. Moreover, what is meant herein by the term "retail personnel" is a person that is employed by the retailer to perform a retail activity such as operation of a checkout terminal such as the checkout terminal 10 for the purpose of conducting a retail transaction such as an assisted checkout transaction. Examples of retail personnel include a checkout clerk or customer service manager.

The checkout terminal 10 includes a pre-scan area 12, an itemization area 14, a payment area 16, and a post-scan area 18. The checkout terminal 10 also includes an item transport mechanism such as input belt assembly 22 and a takeaway belt assembly 36. The checkout terminal 10 may be configured as any type of checkout terminal such as a convertible checkout terminal (i.e. checkout terminal 10 that may be quickly and easily switched between an assisted mode of operation (as shown in FIG. 1) and a self-service mode of operation (as shown in FIG. 2)). One such convertible checkout terminal is a C-Series Checkout Terminal which is commercially available from NCR Corporation of Dayton, Ohio.

The pre-scan area 12 includes the input belt 22 and is located upstream of the itemization area 14. The terms "upstream" and "downstream" are used herein to be consistent with the flow of items through the checkout terminal 10 during a typical checkout procedure. In particular, an item enters at the area proximate the pre-scan area 12 then flows in a downstream direction to be scanned or otherwise entered at the itemization area 14. Once the item is scanned or otherwise entered at the itemization area 14, the item flows from the itemization area 14 in a downstream direction to the post-scan area 18.

The itemization area 14 of the checkout system includes a scanner 24 and a product scale 26. The scanner 24 conventionally scans or reads a product identification code such as a Universal Product Code (UPC), industrial symbol (s), alphanumeric character(s), or other indicia associated with an item to be purchased. One scanner which may be used in the present invention is a model number 7875 bi-optic scanner which is commercially available from NCR Corporation of Dayton, Ohio.

The scanner 24 includes a first scanning window **24*a* and a second scanning window 24*b*. The first scanning window 24*a* is disposed in a substantially horizontal manner, whereas the second scanning window 24*b* is disposed in a substantially vertical manner. More specifically, the checkout terminal 10 includes a number of cabinets 28, 30, 32. A portion of the cabinets 28, 30, 32 define a terminal base 34 which has a substantially horizontal upper surface. The horizontal scanning window 24***a* is disposed in a relatively flush-mount arrangement with the upper surface of the terminal base 34. Moreover, the product scale 26 is integrated with the scanner 24. More specifically, the product scale 26 is disposed substantially parallel to the upper surface of the terminal base 34 and hence the horizontal scanning window 24*a* thereby enveloping the horizontal scanning window 24*a*. If an item such as produce is placed upon the product scale 26 or the horizontal scanning window 24*a*, the product scale 26 may be used to determine the weight of the item.

The scanner 24 also includes a light source (not shown) such as a laser, a rotating mirror (not shown) driven by a motor (not shown), and a mirror array (not shown). In operation, a laser beam reflects off the rotating mirror and mirror array to produce a pattern of scanning light beams. As the product identification code on an item is passed over the scanner 24, the scanning light beams scatter off the code and are returned to the scanner 24 where they are collected and detected. The reflected light is then analyzed electronically in order to determine whether the reflected light contains a valid code pattern. If a valid code pattern is present, the product identification code may then be utilized to retrieve product information associated with the item (e.g. the price of the item).

The scanner 24 and the product scale 26 are movably mounted to the terminal base 34. In particular, the scanner 24 and the product scale 26 are rotatably mounted to a support platform such as a sliding drawer assembly 38. Use of the sliding drawer assembly 38 allows the scanner 24 and the product scale 26 to be rotated relative to the terminal base 34 so as to be operated by either a customer or a checkout clerk. In particular, as shown in FIG. 3, the sliding drawer assembly 38 may be slid out from the terminal base 34 into its extended position such that the scanner 24 (and hence the product scale 26) may be rotated between an assisted scanner position (see FIG. 1) in which the scanner 24 is operable by a checkout clerk, and a self-service scanner position (see FIG. 2) in which the scanner 24 is operable by a customer. Thereafter, the sliding drawer assembly is slid back into its retracted position within the interior of the terminal base 34 such that operation of the scanner 24 by the checkout clerk or the customer may be commenced.

As shown in FIGS. 1–3, the checkout terminal 10 has a customer side 40 and a personnel side 42. More specifically, the terminal base 34 divides the checkout terminal 10 into the customer side 40 which is the side of the checkout terminal 10 where the customer is positioned during a checkout transaction, and the personnel side 42 which is the side of the checkout terminal 10 where retail personnel such as a checkout clerk is located during an assisted checkout transaction. A customer is positioned on the customer side 40 of the checkout terminal 10 irrespective of whether the system 10 is being operated to perform an assisted checkout transaction or a self-service checkout transaction. Use of the rotating scanner 24 facilitates such "same side" operation of the checkout terminal 10. In particular, as shown in FIG. 1, rotation of the scanner 24 into its assisted scanner position causes the vertical scanning window 24*b* to face the personnel side 42 of the checkout terminal 10, whereas rotation of the scanner 24 into its self-service scanner position causes the vertical scanning window 24*b* to face the customer side 40 of the checkout terminal 10 (see FIG. 2). Such a system configuration (i.e. use of the rotating scanner 24 to cause the customer to be positioned on the customer side 40 of the checkout terminal 10 irrespective of whether the system 10 is being operated to perform an assisted checkout transaction or a self-service checkout transaction, and retail personnel to be positioned on the personnel side 42 of the checkout terminal 10) is particularly useful for enhancing system component layout and system placement within the store.

The payment area 16 of the checkout terminal 10 includes the system components necessary to allow a customer to perform finalization functions such as tendering payment for his or her items for purchase and printing of transaction receipts. In particular, the payment area 16 of the checkout terminal 10 includes an electronic payment terminal 44 having a card reader and keypad, a pair of currency acceptors such as a coin acceptor 46 and a bill acceptor 50, a corresponding pair of currency dispensers such as a coin dispenser 48 and a bill dispenser 52, a receipt printer 54, and a cash drawer 56.

The checkout terminal 10 also includes an interactive customer interface terminal 58. The interactive customer interface terminal 58 includes a display device such as a display monitor 58*a* which is provided to display retail information to the customer during operation of the checkout terminal 10. For example, transaction information such as item price, item description, total amount of the transaction, change amount due to the customer, operating instructions, etcetera is displayed to the customer on the display monitor 58*a* during operation of the checkout terminal 10.

The display monitor 58*a* is preferably a known touch screen monitor which can generate data signals when certain areas of the screen are touched by a customer. Hence, the display monitor 58*a* may be utilized by the customer to input information into the checkout terminal 10. For example, the customer may manually enter retail information such as item codes and quantities into the checkout terminal 10 by use of the touch screen associated with the display monitor 58*a*. The customer may indicate his or her preferred method of payment (e.g. cash, credit, or debit card) by touching the appropriate area of the touch screen associated with the display monitor 58*a*. A portion of the touch screen associated with the display monitor 58*a* may also be utilized as a "help button" such that assistance is provided to the customer when it is touched by the customer.

Moreover, the interactive customer interface terminal 58 is preferably embodied as a stand-alone, kiosk-type device which is, in essence, a modified flat panel personal computer (PC) which includes a number of components commonly associated therewith. For example, the interactive customer interface terminal 58 includes components such as a processing unit (not shown) including the associated memory devices (e.g. RAM modules), along with other commonly utilized PC components such as an Ethernet controller, a number of video and audio control devices, a storage memory device such as a hard drive device, and a number of connector ports for coupling the interface terminal 58 to a number of retail peripheral devices such as the scanner 24, the product scale 26, and the components associated with the payment area 16. Hence, in addition to displaying transaction information to the customer, the interactive customer interface terminal 58 functions as the main processing device or controller for controlling operation of the checkout terminal 10. It should be appreciated that the interactive customer interface terminal 58 may be embodied as any stand-alone, kiosk-type device which includes the afore-described components (e.g. a display monitor, PC, etcetera). One such stand-alone, kiosk-type device which is particularly useful as the interactive customer interface terminal of the present invention is an Informa model information terminal which is commercially available from NCR Corporation.

The checkout terminal 10 also includes a personnel interface terminal 60 having a display device such as a display monitor 60*a* and a keypad 60*b* (see FIG. 3). Transaction information such as item price, item description, total amount of the transaction, change amount owed to the customer, etcetera is displayed to the checkout clerk via the display monitor 60*a* during operation of the checkout terminal 10 by the clerk. Moreover, the checkout clerk may manually enter retail information such as item codes and quantities into the checkout terminal 10 by use of the keypad 60*b* associated with the personnel interface terminal 60. The personnel interface terminal 60 of the present invention may be embodied as a single, integrated device (as shown in FIG. 3) having both the display monitor 60*a* and the keypad 60*b*, or alternatively, the display monitor 60*a* and the keypad 60*b* may be embodied as separate components. One integrated terminal which is particularly useful as the personnel interface terminal 60 of the present invention is a Dynakey terminal which is commercially available from NCR Corporation.

As shown in FIG. 1, a number of the system components associated with the payment area are configured to be operated by the customer when the customer is positioned on the customer side 40 of the checkout terminal 10. In particular, a number of the system components associated with the payment area 16 are positioned to face the customer side 40 of the checkout terminal 10 so as to be accessible to a customer during a checkout transaction. Such a configuration allows the customer to operate the system components of the payment area 16 himself or herself in order to tender payment for his or her items for purchase at the terminal 10 thereby eliminating the need to provide remote payment stations during operation of the checkout terminal 10 in its self-service mode of operation. Such a configuration overcomes an expensive drawback of other terminal designs which require the use of such remote payment stations.

As alluded to above, the system components associated with the payment area 16 of the checkout terminal 10 which face the customer side 40 of the terminal 10 are particularly useful for allowing the customer to tender payment for his or her items for purchase when the checkout terminal 10 is being operated in its self-service mode of operation. In particular, once the customer has entered all of his or her items for purchase into the checkout terminal 10 during a self-service checkout transaction, the components associated with the payment area 16 are utilized to complete the self-service checkout transaction by (1) allowing payment to be tendered by either insertion of currency into a currency acceptor (i.e. the coin acceptor 46 and/or the bill acceptor 50), charging a credit card or debit card account, or decreasing a value amount stored on a smart card via the electronic payment terminal 44, and (2) printing a transaction receipt with the receipt printer 54. In the case of when a customer inserts currency into the coin acceptor 46 and/or the bill acceptor 50, the checkout terminal 10 may provide change via a currency dispenser (i.e. the coin dispenser 48 and/or the bill dispenser 52).

In a conventional manner, certain of the system components associated with the payment area 16 of the checkout terminal 10 may be utilized during operation of the checkout terminal 10 in its assisted mode of operation. In particular, once the checkout clerk operating the checkout terminal 10 has entered the last of the customer's items for purchase, the checkout clerk may utilize the cash drawer 56 to collect currency from the customer and thereafter tender change in a conventional manner.

Alternatively, unlike heretofore designed convertible checkout terminals, the concepts of the present invention allow for certain of the components associated with the payment area 16 which are generally utilized only when the checkout terminal 10 is being operated in its self-service mode of operation to also be utilized to finalize or otherwise complete the customer's transaction without additional intervention or assistance from the checkout clerk when the checkout terminal 10 is being operated in its assisted mode of operation. In particular, after the checkout clerk has entered the last item associated with a checkout transaction, the customer may tender payment for the checkout transaction by either inserting currency into a currency acceptor (i.e. the coin acceptor 46 and/or the bill acceptor 50), charging a credit card or debit card account, or decreasing a value amount stored on a smart card via the electronic payment terminal 44. In the case of when a customer inserts currency into the coin acceptor 46 and/or the bill acceptor 50, the checkout terminal 10 may provide change via a currency dispenser (i.e. the coin dispenser 48 and/or the bill dispenser 52). Thereafter, a transaction receipt is printed by the receipt printer 54 for presentation to the customer without assistance from retail personnel.

Figure 4:
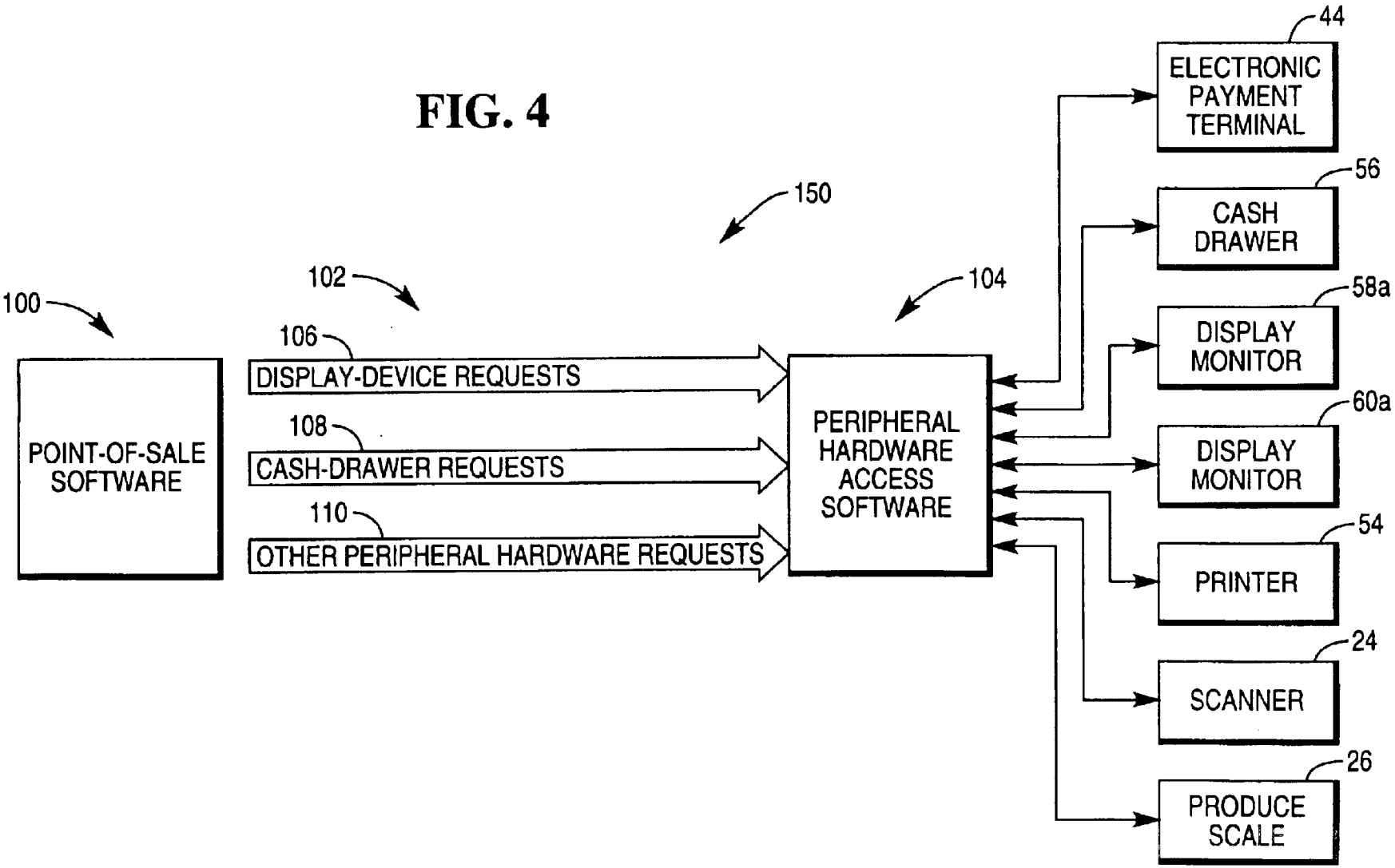
FIG. 4 is a block diagram showing a portion of the traditional terminal software architecture which is utilized to operate the retail checkout terminal of FIGS. 1–3 in its assisted mode of operation when the terminal's currency handlers are not being operated.

In order to operate the checkout terminal 10 in the above-described manners, a number of software schemes are utilized. In particular, as shown in FIG. 4, a traditional terminal software architecture 150 may be utilized to tender payment during an assisted checkout transaction in the first manner described above (i.e. by the clerk's use of the cash drawer). Specifically, point-of-sale software 100 is utilized to control operation of the checkout terminal 10 during a checkout transaction. At the required times during the transaction, various peripheral-request control signals (hereinafter "requests") 102 are generated and transmitted to peripheral hardware access software 104 which in turn generates the necessary control signals to control operation of the various retail peripherals such as the scanner 24, the product scale 26, the electronic payment terminal 44, the printer 54, the display monitors 58*a*, 60*a*, and/or the cash drawer 56.

For example, at the appropriate time during a checkout transaction, the point-of-sale software 100 may generate a display-device request 106 which includes instructions for displaying certain information on either or both of the display monitors 58*a*, 60*a*. The peripheral hardware access software 104, in turn, utilizes the instructions in the display-device request 106 to communicate with the display monitors 58*a*, 60*a* in order to cause the monitors 58*a*, 60*a* to display the required information. For example, such a request 106 may include instructions for displaying a transaction total amount or an amount of change due to a customer at the end of a transaction.

Similarly, at the appropriate time during a checkout transaction, the point-of-sale software 100 may generate a cash-drawer request 108 which includes instructions for opening the cash drawer 56 in order to allow the checkout clerk to access the funds within the drawer 56 for the purpose of collecting payment from the customer and thereafter tendering any change due to the customer. The peripheral hardware access software 106 utilizes the instructions in the cash-drawer request 108 to communicate with the cash drawer 56 in order to cause the cash drawer 56 to open. It should be appreciated that the cash drawer 56 also communicates back to the peripheral hardware access software 104 when the drawer 56 is subsequently closed. Such information (i.e. closure of the drawer 56) is then communicated back to the point-of-sale software 100.

As shown in FIG. 4, a number of other peripheral hardware requests 110 may also be generated and communicated to the peripheral hardware access software 104 during a checkout transaction. For example, requests 110 for operation of the electronic payment terminal 44 may be generated which are then communicated to the terminal 44 via the peripheral hardware access software 104 in order cause the terminal 44 to perform a desired function. Likewise, a request 110 for operating the printer 54 may be generated and then communicated to the printer 54 via the peripheral hardware access software 104 in order cause the printer 54 to perform a desired function. Moreover, requests 110 for operation of the scanner 24 or the product scale 26 may also be generated which are then communicated to the scanner 24 or the product scale 26, respectively, via the peripheral hardware access software 104 in order cause the scanner 24 or the product scale 26 to perform a desired function. It should be appreciated that such a desired function may be to "lock out" the scanner 24 or the product scale 26 in order to prevent input therefrom.

In any event, it should be appreciated from the above discussion that the point-of-sale software 100 communicates with the peripheral hardware access software 104 in order to control the numerous peripherals associated with the terminal 10 thereby allowing a checkout clerk to complete a checkout transaction. As shall now be discussed in detail, the concepts of the present invention also utilize such communications between the point-of-sale software 100 and the peripheral hardware access software 104 in order to provide additional functionality to the terminal 10 without requiring modification to the traditional terminal software architecture 150.

Figure 5:
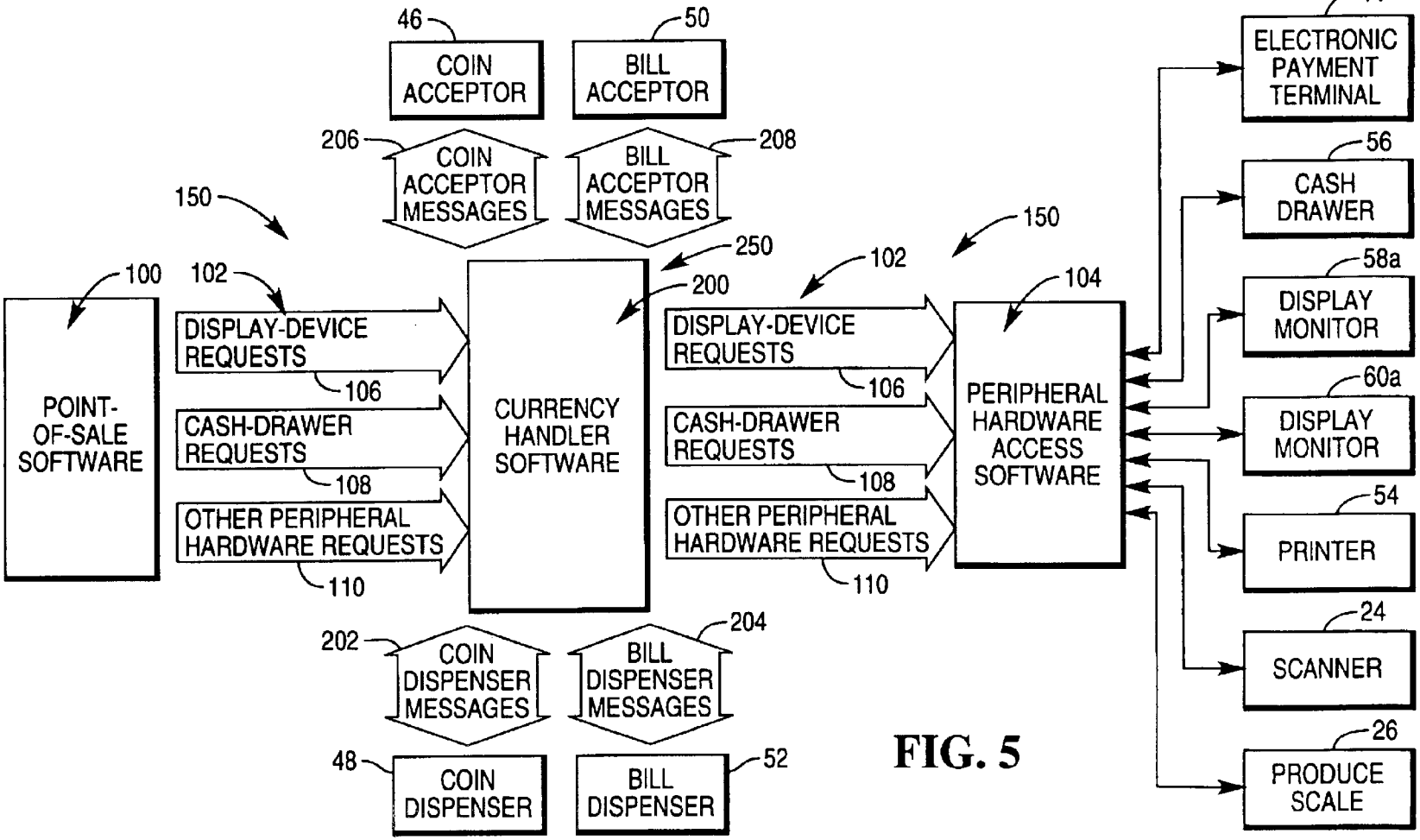
FIG. 5 is block diagram similar to FIG. 4, but showing a portion of an enhanced terminal software architecture which is utilized to operate the retail checkout terminal in its assisted mode of operation when the terminal's currency handlers are being operated.

As shown in FIG. 5, an enhanced terminal software architecture 250 utilizes currency handler software 200 in conjunction with the traditional terminal software architecture 150 to allow for the use of the currency handler devices (e.g. the coin acceptor 46, the bill acceptor 50, the coin dispenser 48, and the bill dispenser 52) associated with the payment area 16 of the terminal 10. As shall be described below, use of the currency handler software 200 requires no modification whatsoever to the traditional software architecture 150.

The currency handler software 200 monitors the peripheral hardware requests 102 between the point-of-sale software 100 and the peripheral hardware access software 104 in order to determine information necessary for operation of the currency handler devices. The currency handler software 200, in turn, utilizes the information contained in the peripheral hardware requests 102 to generate signals for controlling operation of the coin acceptor 46, the bill acceptor 50, the coin dispenser 48, and the bill dispenser 52.

For example, if the currency handler software 200 detects generation of a cash-drawer request 108, the software 200 may conclude that change is due to the customer. The currency handler software 200 may then monitor the instructions included in any display-device requests 106 in order to determine the amount of change to be dispensed to the customer since such an amount is typically displayed on the one of the display monitors 58*a*, 60*a* associated with the terminal 10 for use by the checkout clerk and/or the customer. The currency handler software 200 may then utilize the information included in the detected requests to generate a number of requests such as coin requests 202 for dispensing the proper number and type of coins via the coin dispenser 48 and/or bill requests 204 for dispensing the proper number and types of bills via the bill dispenser 52.

As a further example, the currency handler software 200 may utilize the instructions included only in the display-device requests 106 in order to operate the currency handlers. For example, in lieu of the cash-drawer request 108, the display-device request 106 which includes the amount of change to be dispensed to the customer may be utilized by the currency handler software 200 to operate the currency handlers. Specifically, the currency handler software 200 may utilize the information included in the detected display-device requests 108 to not only determine the amount of change owed to the customer (as described above), but also the appropriate time to dispense such change owed the customer. In a similar manner to as described above, the currency handler software 200 would then utilize such information to generate a number of requests for dispensing the proper number and types of coins and bills via the coin dispenser 48 and the bill dispenser 52, respectively.

Moreover, as shown in FIG. 5, the currency handler software 200 may also monitor requests 102 between the point-of-sale software 100 and the peripheral hardware access software 104 in order to control operation of the coin acceptor 46 and the bill acceptor 50. In particular, the currency handler software 200 may monitor the instructions included in display-device requests 106 in order to determine the total dollar amount of a customer's transaction since such an amount is typically displayed on the one or both of the display monitors 58*a*, 60*a* associated with the terminal 10 for use by the checkout clerk and/or the customer. The currency handler software 200 may then utilize the information included in the detected display-device requests 106 to generate a number of requests such as coin requests 206 for accepting the proper number and type of coins via the coin acceptor 46 and/or bill requests 208 for accepting the proper number and type of bills via the bill acceptor 50. It should be appreciated that in the case of accepting currency via the currency acceptors, the currency handler software 200 may also be utilized to compute the amount of change, if any, due the customer and then dispense the same with one or both of the currency dispensers.

It should be appreciated that although the exemplary embodiments described herein primarily utilize display-device requests 106 and/or cash-drawer requests 108 to operate the currency handlers, any number of other peripheral requests 102 may be utilized to operate the currency handlers according to the present invention. For example, peripheral requests associated with the electronic payment terminal 44 may be monitored to determine if the customer is owed "cash back" from a debit transaction. In such a case, the bill dispenser 52 may be utilized to tender such "cash back" in lieu of the cash drawer 56. Similarly, the currency handler software 200 may be configured to utilize peripheral requests 102 associated with other peripherals (e.g. the scanner 24, the product scale 26, etcetera) to determine the nature of any necessary operation of the currency handlers. Moreover, requests 102 directed to non-existent peripheral devices or unused data connections may also be utilized by the currency handler software 200. For example, if the point-of-sale software 100 is configured to communicate requests 102 to a particular data port associated with the terminal's processing unit, but such a data port is unused (i.e. not connected to a peripheral, network, or the like), the information included in such requests 102 may be utilized by currency handler software 200 even though the requests 102 would otherwise not be utilized.

In one exemplary embodiment of the present invention, the peripheral requests 102 are only monitored by the currency handler software 200. Indeed, as shown in FIG. 5, even though the peripheral requests 102 are utilized by the currency handler software 200 to operate the currency handlers, the requests 102 are still received by the peripheral hardware access software 104 and, as a result, still cause the associated peripheral device to perform the desired function. For example, in regard to the embodiment shown in FIG. 5, even though the currency handler software 200 operates the currency dispensers 48, 52 to dispense the amount of change owed to the customer (based on, for example, one or more display-device requests 106 and/or cash-drawer requests 108), generation of the display-device request 106 by the point-of-sale software 100 still causes the information contained therein to be displayed on one or both of the display monitors 58*a*, 60*a*. This is true since the currency handler software 200 only monitors the display-device requests 106, but does not intervene in regard to the transmission thereof. As a result, the requests 106 are still received by the peripheral hardware access software 104 and, as a result, the information contained therein is displayed on one or both of the display monitors 58*a*, 60*a*.

Similarly, in the case of when the terminal 10 is being operated in a manner in which the checkout clerk is accepting payment from the customer via use of the cash drawer 56, but utilizing the currency dispensers 48, 52 to dispense the amount of change owed the customer, the cash-drawer request 108 monitored by the currency handler software 200 is still received by the peripheral hardware access software, as shown in FIG. 5, and, as a result, still causes the cash drawer 56 to be opened. This is done since it is necessary to open the drawer 56 so that the clerk may place currency collected from the customer in the drawer 56 even though the clerk will not make change from the drawer 56.

While such an arrangement may be advantageous during operation of the terminal 10 in certain configurations, in other operational configurations it may be desirable to "intercept" certain types of peripheral requests 102 prior to receipt thereof by the peripheral hardware access software 104. For example, while it is desirable to allow the contents of the display-device requests 106 to be received by the peripheral hardware access software 104 (and hence executed by the display monitors 58*a*, 60*a* in the manner described above), it may be desirable to "block" certain other requests such as cash-drawer requests 108 when the terminal 10 is being operated in a manner which does not utilize the cash drawer 56. For example, in the case of when the terminal 10 is being operated such that the currency handler software 200 is utilized to operate the currency acceptors 46, 50 and the currency dispensers 48, 52 to both accept currency from a customer and thereafter dispense the amount of change owed to the customer (i.e. the terminal 10 is operated without the use of the cash drawer 56), it is desirable to prevent the cash drawer 56 from being opened. Hence, as shown in FIG. 6, the currency handler software 200 may also be configured to intervene in the processing of any number of peripheral requests 102 generated by the point-of-sale software 100.

Figure 6:
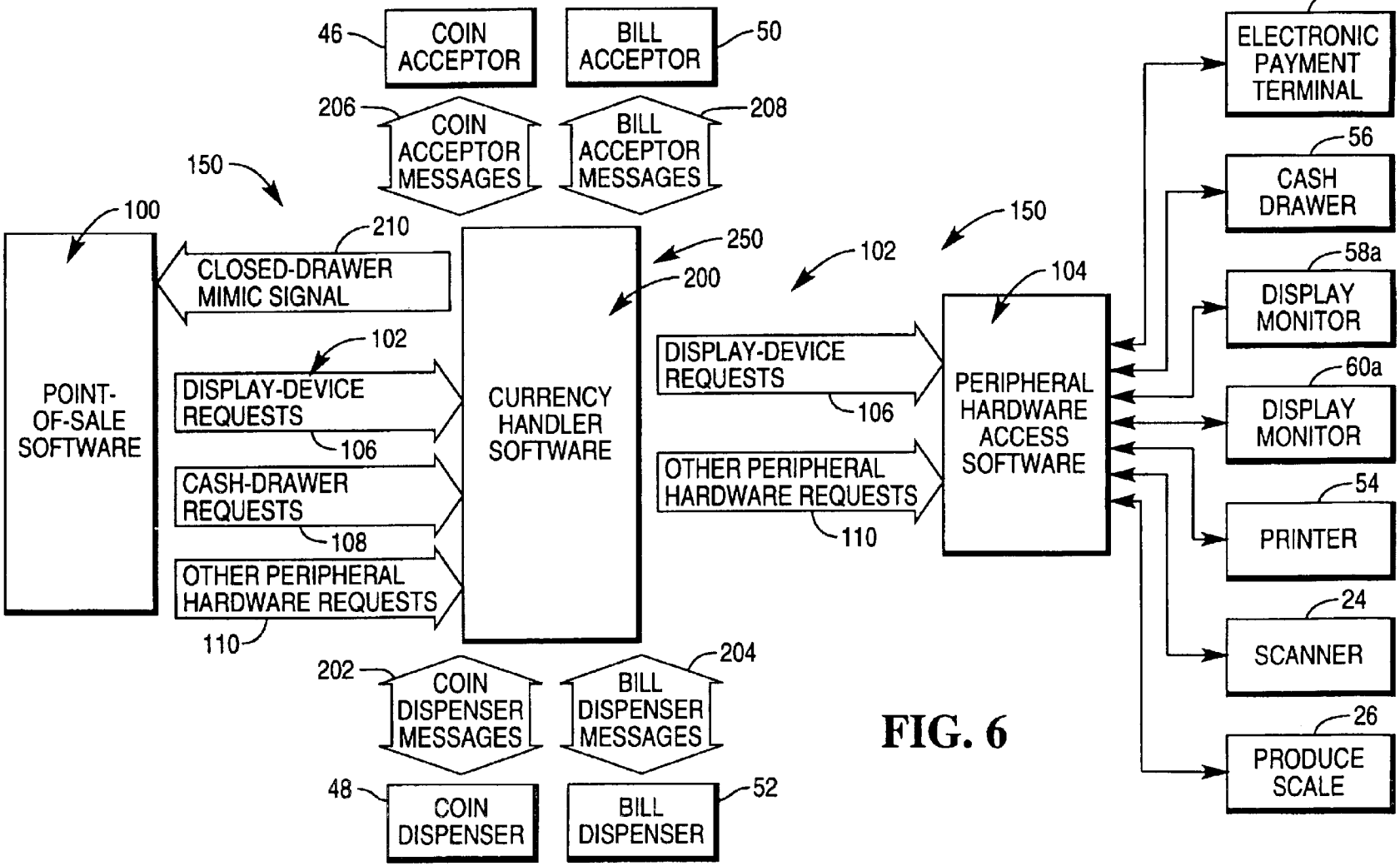
FIG. 6 is a block diagram similar to FIG. 5, but showing an alternative configuration of the enhanced terminal software architecture.

For example, as shown in FIG. 6, in the case of when the terminal 10 is being operated such that the currency handler software 200 is utilized to operate the currency acceptors 46, 50 and the currency dispensers 48, 52 to both accept currency from a customer and thereafter dispense the amount of change owed to the customer (i.e. the terminal 10 is operated without the use of the cash drawer 56), the detected cash-drawer request 108 may be utilized by the currency handler software 200 to commence operation of the currency handlers (or may be completely ignored in the case of when only the display-device requests 106 are utilized, as described above). However, the currency handler software 200 prevents the cash-drawer request 108 from being communicated to the peripheral hardware access software 104, as shown in FIG. 6. Alternatively, the currency handler software 200 may allow the cash-drawer request 108 to be received by the peripheral hardware access software 200, while simultaneously sending an override request to the peripheral hardware access software 200 which effectively overrides or otherwise prevents execution of the instructions contained in the cash-drawer request 108 by the peripheral hardware access software 104.

In either event, the currency handler software 200 effectively prevents the cash drawer 56 from being opened. However, the point-of-sale software 100 will typically require a return signal from peripheral hardware access software 104 which indicates that the cash drawer 56 has been closed by the checkout clerk in response to, for example, the clerk's completion of the transaction by collecting cash from the customer and thereafter tendering any change due to the customer from the cash drawer 56. However, in the present case, no such "drawer-closed" signal will be generated by the cash drawer 56 and hence transmitted to the point-of-sale software 100 via the peripheral hardware access software) since the drawer 56 was never opened in the first place. As such, the currency handler software 200 is configured to generate a request 210 which mimics the drawer-closed signal typically generated by the peripheral hardware access software 104 when the software 104 receives the corresponding signal from the cash drawer 56. In such a manner, the point-of-sale software 100 "believes" that the cash drawer 56 has been closed thereby allowing the point-of-sale software 100 to execute the next instruction associated with the checkout transaction. It should be appreciated that the request 210 mimicking the closed-drawer signal is not generated by the currency handler software 200 until all of the necessary funds have been tendered by the customer via the currency acceptors 46, 50 and the associated change due the customer has been tendered by the currency dispensers 48, 52.

It should be appreciated that the cash-drawer request 108 may also be intercepted for other reasons. For example, the currency handler software 200 may be configured to intercept the cash-drawer request 108 in the situation of when "cash back" is being tendered to the customer during a debit card transaction via the currency dispensers 48, 52. Moreover, it should also be appreciated that the currency handler software 200 may also be configured to intercept any other type of peripheral hardware request 102 which fits the needs of a given design of the checkout terminal 10.

Hence, as described herein, the concepts of the present invention have numerous advantages over heretofore designed systems and methods. For example, by designing the currency handler software 200 to work in conjunction with existing terminal software architectures, operation of the currency handlers may be provided without requiring expensive rewriting or retrofitting of the original terminal software architecture. This is particularly useful in the case of retrofitting an existing retail terminal with cash handlers.

Moreover, since the concepts of the present invention do not require any modification to the existing terminal point-of-sale software and peripheral hardware access software, terminals of any brand type (i.e. any manufacturer) may be retrofitted to include the software concepts of the present invention. Specifically, a competitive advantage is achieved by the concepts of the present invention since the software enhancements described herein (e.g. the currency acceptor software 200) may be configured to operate with any existing software architecture irrespective of the manufacturer of the terminal.

As alluded to above, the concepts of the present invention are also useful in regard to the design of a convertible checkout terminal. Specifically, an existing "self-service" software architecture may be utilized while the terminal is being operated in its self-service mode of operation. During operation of the terminal in its assisted mode of operation, an existing "assisted" terminal software architecture may be utilized. In doing so, if the retailer so desires, the software concepts of the present invention may be utilized to supplement the existing assisted terminal software architecture to allow for the use of the currency handlers in the manner described above. This is particularly useful in the case of convertible checkout terminals since such currency handlers are typically present on the terminal anyway (for use in its self-service mode), but would otherwise go unused when the terminal is being operated in its assisted mode of operation. Such use of the concepts of the present invention allow for operation of the currency handlers while avoiding the costs associated with expensive rewriting or retrofitting of existing software applications.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

There are a plurality of advantages of the present invention arising from the various features of the checkout terminal and associated methods described herein. It will be noted that alternative embodiments of the checkout terminal and associated methods of the present invention may not include all of the features described yet still benefit from at least some of the advantages of such features. Those of ordinary skill in the art may readily devise their own implementations of a checkout terminal and associated methods that incorporate one or more of the features of the present invention and fall within the spirit and scope of the present invention as defined by the appended claims.

What is claimed is:

1. A method of operating a checkout terminal, comprising the steps of:

detecting generation of a peripheral-request control signal, said peripheral-request control signal including instructions for operating a retail peripheral device;

generating a dispenser control signal in response to said detecting step; and operating a currency dispenser so as to dispense an amount of change due to a customer in response to said dispenser control signal, wherein said currency dispenser is distinct from said retail peripheral device.

2. The method of claim 1, wherein:

said retail peripheral device includes a display device, and said detecting step includes the step of detecting generation of a display-device control signal, said display-device control signal including instructions for displaying information on said display device.

3. The method of claim 2, wherein:

said instructions for displaying information on said display device include instructions for displaying said amount of change due to said customer on said display device, and said operating step includes the step of operating said currency dispenser so as to tender said amount of change due to said customer based on said instructions for displaying said amount of change due to said customer.

4. The method of claim 1, wherein:

said retail peripheral device includes a cash drawer device, and said detecting step includes the step of detecting generation of a cash-drawer control signal, said cash-drawer control signal including instructions for opening said cash drawer device.

5. The method of claim 1, wherein:

said currency dispenser includes a bill dispenser, and said operating step includes the step of operating said bill dispenser so as to dispense a number of bills associated with said amount of change due to said customer.

6. The method of claim 1, wherein:

said currency dispenser includes a coin dispenser, and said operating step includes the step of operating said coin dispenser so as to dispense a number of coins associated with said amount of change due to said customer.

7. The method of claim 1, further comprising the step of operating said retail peripheral device based on said instructions included in said peripheral-request control signal.

8. The method of claim 7, wherein:

said retail peripheral device includes a display device, and said step of operating said retail peripheral device includes the step of operating said display device so as to display said amount of change due to said customer based on said instructions included in said peripheral-request control signal.

9. A checkout terminal, comprising:

a retail peripheral device;

a currency dispenser which is distinct from said retail peripheral device;

a processing unit electrically coupled to both said retail peripheral device and said currency dispenser; and a memory device electrically coupled to said processing unit, wherein said memory device has stored therein a plurality of instructions which, when executed by said processing unit, causes said processing unit to:

(a) detect generation of a peripheral-request control signal, said peripheral-request control signal including instructions for operating said retail peripheral device, (b) generate a dispenser control signal in response to said detection of generation of said peripheral request control signal, and (c) operate said currency dispenser so as to dispense an amount of change due to a customer in response to said dispenser control signal.

10. The checkout terminal of claim 9, wherein:

said retail peripheral device includes a display device, and said plurality of instructions, when executed by said processing unit, further causes said processing unit to detect generation of a display-device control signal, said display-device control signal including instructions for displaying information on said display device.

11. The checkout terminal of claim 10, wherein:

said instructions for displaying information on said display device include instructions for displaying said amount of change due to said customer on said display device, and said plurality of instructions, when executed by said processing unit, further causes said processing unit to operate said currency dispenser so as to tender said amount of change due to said customer based on said instructions for displaying said amount of change due to said customer.

12. The checkout terminal of claim 9, wherein:

said retail peripheral device includes a cash drawer device, and said plurality of instructions, when executed by said processing unit, further causes said processing unit to detect generation of a cash-drawer control signal, said cash-drawer control signal including instructions for opening said cash drawer device.

13. The checkout terminal of claim 9, wherein:

said currency dispenser includes a bill dispenser, and said plurality of instructions, when executed by said processing unit, further causes said processing unit to operate said bill dispenser so as to dispense a number of bills associated with said amount of change due to said customer.

14. The checkout terminal of claim 9, wherein:

said currency dispenser includes a coin dispenser, and said plurality of instructions, when executed by said processing unit, further causes said processing unit to operate said coin dispenser so as to dispense a number of coins associated with said amount of change due to said customer.

15. The checkout terminal of claim 9, said plurality of instructions, when executed by said processing unit, further causes said processing unit to operate said retail peripheral device based on said instructions included in said peripheral-request control signal.

16. The checkout terminal of claim 15, wherein:

said retail peripheral device includes a display device, and said plurality of instructions, when executed by said processing unit, further causes said processing unit to operate said display device so as to display said amount of change due to said customer based on said instructions included in said peripheral-request control signal.

17. A method of operating a checkout terminal, comprising the steps of:

detecting generation of a display-device control signal, said display-device control signal including instructions for displaying information on said display device;

generating a currency control signal in response to said detecting step; and operating a currency handler in response to said currency control signal.

18. The method of claim 17, wherein:

said currency handler includes a currency dispenser, said instructions for displaying information on said display device include instructions for displaying an amount of change due to a customer on said display device, and said operating step includes the step of operating said currency dispenser so as to tender said amount of change due to said customer based on said instructions for displaying said amount of change due to said customer.

19. The method of claim 17, wherein:

said currency handler includes a currency acceptor, said instructions for displaying information on said display device include instructions for displaying a transaction total amount on said display device, and said operating step includes the step of operating said currency acceptor so as to accept currency from a customer based on said instructions for displaying said transaction total amount on said display device.

20. A method of operating a checkout terminal comprising:

generating a first signal usable in controlling a first peripheral device;

detecting the generation of the first signal; and generating a second signal usable in controlling a second peripheral device in response to the detection of the generation of the first signal.

21. The method of claim 20, further comprising:

detecting data in the first generated signal; and controlling the second device using the detected data.

22. The method of claim 21, wherein:

the step of detecting data comprises detecting an amount of currency to be given to a customer; and the step of controlling the second device comprises controlling a currency dispenser to dispense at least a portion of the amount of currency to be given to a customer.

23. The method of claim 21, wherein the step of controlling the second device comprises:

controlling a coin dispenser to dispense at least a portion of the amount of currency to be given to a customer; and controlling a bill dispenser to dispense at least a portion of the amount of currency to be given to a customer.

24. The method of claim 21, further comprising:

blocking the first generated signal such that the first peripheral device is not controlled in accordance with the first generated signal.

25. The method of claim 24, wherein said step of generating a first signal usable in controlling a first peripheral device comprises generating a signal usable in controlling a cash drawer device;

said step of detecting the generation of the first signal comprises detecting the generation of the signal usable in controlling the cash drawer device;

said step of detecting data in the first generated signal comprises detecting instructions for opening the cash drawer device; and said step of blocking the first generated signal comprises blocking the signal usable in controlling the cash drawer device such that the cash drawer is not opened.

26. The method of claim 25, further comprising:

generating a signal mimicking a cash drawer closed signal.

* * * * *